United States Patent [19]

Balandin et al.

[11] 4,142,133

[45] Feb. 27, 1979

[54] CATHODE-RAY TUBE WITH VARIABLE ENERGY OF BEAM ELECTRONS

[76] Inventors: Genrikh D. Balandin, ulitsa Toentralnaya 4a, kv. 23, Fryazino Moskovskoi oblasti; Nikolai G. Rumyantsev, ulitsa Konsomolskaya 7/1, kv. 106, Schelkovo Moskovskoi oblasti, both of U.S.S.R.

[21] Appl. No.: 804,815

[22] Filed: Jun. 8, 1977

Related U.S. Application Data

[60] Division of Ser. No. 734,272, Oct. 20, 1976, Pat. No. 4,044,282, which is a continuation of Ser. No. 515,633, Oct. 17, 1976, abandoned.

[51] Int. Cl.[2] ..... H01J 29/56; H01J 29/64

[52] U.S. Cl. ..... 315/382; 313/433; 313/431; 313/450

[58] Field of Search ..... 313/414, 433, 448, 449, 313/442, 450; 315/382

[56] References Cited

U.S. PATENT DOCUMENTS

| | | | |
|---|---|---|---|
| 2,227,034 | 12/1940 | Schlesinger | 313/421 |
| 2,888,606 | 5/1959 | Beam | 313/449 X |
| 2,954,499 | 9/1960 | Gundert et al. | 313/432 X |
| 3,023,336 | 2/1962 | Frenkel | 313/433 |
| 3,040,205 | 6/1962 | Walker | 313/450 X |
| 3,143,681 | 8/1964 | Schlesinger | 313/450 |
| 3,295,001 | 12/1966 | Burdick et al. | 313/448 |
| 3,375,390 | 3/1968 | Schlesinger | 313/450 |
| 3,696,261 | 10/1972 | Miyaoka | 313/414 X |
| 3,748,514 | 7/1973 | Standaart | 313/450 X |
| 3,778,666 | 12/1973 | Miyaoka et al. | 313/413 X |
| 3,887,830 | 6/1975 | Spencer | 313/448 X |

*Primary Examiner*—Robert Segal
*Attorney, Agent, or Firm*—Haseltine, Lake & Waters

[57] ABSTRACT

A cathode-ray tube with variable energy of electrons of a beam formed by an electron accelerating means and an electron focusing means which are arranged in tandem along the beam axis. The electron focusing means comprises a magnetic lens with a constant magnetic-field intensity and an electrostatic lens so arranged with respect to the magnetic lens that defocusing of the electron beam by the magnetic lens, due to variations in the energy of the beam electrons, is compensated for. The electrostatic lens comprises two axisymmetric electrodes, the first electrode being electrically associated with the electron accelerating means, along the beam axis, and the second electrode being electrically associated with the screen of the cathode-ray tube.

2 Claims, 3 Drawing Figures

CATHODE-RAY TUBE WITH VARIABLE ENERGY OF BEAM ELECTRONS

BACKGROUND OF THE INVENTION

The present application is a division of the parent application Ser. No. 734,272, filed Oct. 20, 1976, now U.S. Pat. No. 4,044,282, of Aug. 23, 1977, which is a continuation of Ser. No. 515,633, filed Oct. 17, 1976, now abandoned.

The present invention relates to electron-beam devices, and more particularly to cathode-ray tubes with variable energy of electrons of their beams, intended for use, generally, in information display systems.

A new class of cathode-ray tubes (CRT) has recently come into being, that of cathode-ray tubes with variable energy (rate) electrons in their beams, depending on which the color of glow, afterglow duration or other characteristics of the tube screen vary accordingly. These tubes operate on the principle of different depth of penetration of an electron beam into a solid body (in this case, the tube screen) depending on the energy of the beam electrons. They are generally known as "penetron" tubes.

The screen of such a cathode-ray tube is composite, including a number of superimposed layers, separated by a barrier layer of materials exhibiting different properties when exposed to an electron beam, e.g. different color of glow, different afterglow duration, coloring (darkening) ability. When an electron beam impinges upon such a screen, depending on the energy of its electrons, i.e. the accelerating voltages, it will penetrate a respective layer, exciting it. According to an alternative embodiment of such tubes, the screen may be in the form of a single layer including particles coated with a number of layers exhibiting different properties.

In the process of operation of these cathode-ray tubes, the energy of the beam electrons has to be varied rapidly with the video frequency, i.e. the accelerating voltage has to be varied from a lower level (normally within 4 to 8 kV) to a higher level (normally within 8 to 15 kV) or vice versa. This is usually followed by defocusing of the electron beam on the screen, which necessitates means for compensating for this defocusing.

In most prior art cathode-ray tubes with variable energy of electrons in their beams, an electrostatic lens is used as the main focusing lens. In this case, dynamic focusing adjustment of the electron beam is introduced, as the energy of the beam electrons varies, consisting of applying a focusing signal from a special generator to one of the electrodes of the electrostatic lens each time a variation in the beam electron energy occurs.

It is well known that the use of an electrostatic lens as the main focusing lens substantially limits the resolution of the cathode-ray tube in which it is used, particularly in the case of the electron beams' current intensity being 100 $\mu$A and over.

Despite the theoretical possibility of improving the resolution of a cathode-ray tube by using a magnetic lens as its main focusing lens, where the magnetic lens includes an electromagnetic coil with an inductance of about 200 mH, it was not widely used until quite recently because the electromagnetic coil varies simultaneously with beam electron energy variations.

A cathode-ray tube with variable beam electron energy is also known, comprising a source of electrons which are focused into a beam with the aid of an electron accelerating and an electron focusing means, the latter including a magnetic lens, as well as an electron beam deflecting means arranged downstream of the magnetic lens along the beam axis.

In this prior art cathode-ray tube, the magnetic lens is built around an electromagnetic coil of a special structure. In this case as well as in the case of using electrostatic focusing lenses, to effect focusing adjustment of the electron beam as the energy of its electrons varies, a focusing signal is applied to the electromagnetic coil from a separate generator, which complicates the cathode-ray tube control circuit.

The magnetic lens formed by said electromagnetic coil is not adequately short to provide for optimal focusing of the electron beam, this being due to the air gap in its magnetic core being made substantially greater than in other prior art electromagnetic focusing coils with a view to decreasing its inductance. Moreover, despite the inductance of the coil being decreased, the limitations imposed on the rate of change of the magnetic flux in the coil, hence, on the quick action of the cathode-ray tube, cannot be fully eliminated.

It is an object of the present invention to provide a cathode-ray tube with variable energy of electrons in its beam, in which the electron beam can be automatically focused on the tube screen each time the energy of electrons of this beam varies.

Another object of the invention is to automatically maintain the invariable size of the characters appearing on the screen.

The principle object of the present invention is to provide a cathode-ray tube with variable energy of electrons in its beam, in which the electron beam can be automatically focused on the tube screen and the size of the characters appearing on the screen can be automatically maintained invariable each time the energy of electrons of this beam varies.

SUMMARY OF THE INVENTION

This object is attained by means of a cathode-ray tube having variable energy of electrons in its beam formed by an electron accelerating means and an electron focusing means, arranged in tandem along the axis of this beam, which is made to scan a screen with the aid of a beam deflecting means arranged downstream of the electron focusing means along the beam axis. According to a major feature of the invention, the electron focusing means is made up of a magnetic lens with a constant magnetic field intensity and an electrostatic lens arranged as follows: The electrostatic lens is placed with respect to the magnetic lens so that defocusing of the electron beam by the magnetic lens, due to variations in the energy of the beam electrons, is compensated for. The electrostatic lens comprises two axisymmetric electrodes, the first electrode being electrically connected with the electron accelerating means and the second electrode with the screen.

It is expedient that the ends of the electrostatic lens electrodes, facing each other, be arranged upstream of the median plane of the magnetic lens, along the beam axis.

It is also expedient that the ends of the electrostatic lens electrodes, facing each other, be arranged on either side of the median plane of the magnetic lens, the distance therebetween exceeding the diameter of the end of the smaller electrode, and that the electrodes are electrically connected with each other through a means for setting up a distributed electric field, disposed between said electrodes.

The means for setting up a distributed electric field should preferably be made in the form of a strip of a resistive material, bent along a helical line.

Preferably, the means for setting up a distributed electric field can also be made in the form of a number of diaphragms electrically interconnected by means of members made of a resistive material.

It is also advisable that the cathode-ray tube be provided with an additional electron beam deflecting means arranged between the electron accelerating means and the first electrostatic lens electrode, along the beam axis.

Such a structure of the proposed cathode-ray tube with variable energy of electrons in its beam offers a high resolution of about 2,500 lines per screen, substantially simplifies the control circuit and improves its quick response.

BRIEF DESCRIPTION OF THE DRAWINGS

The invention will now be described in greater detail with reference to specific embodiments thereof, taken in conjunction with the accompanying drawings, wherein.

DESCRIPTION OF THE PREFERRED EMBODIMENTS

Figure 1:
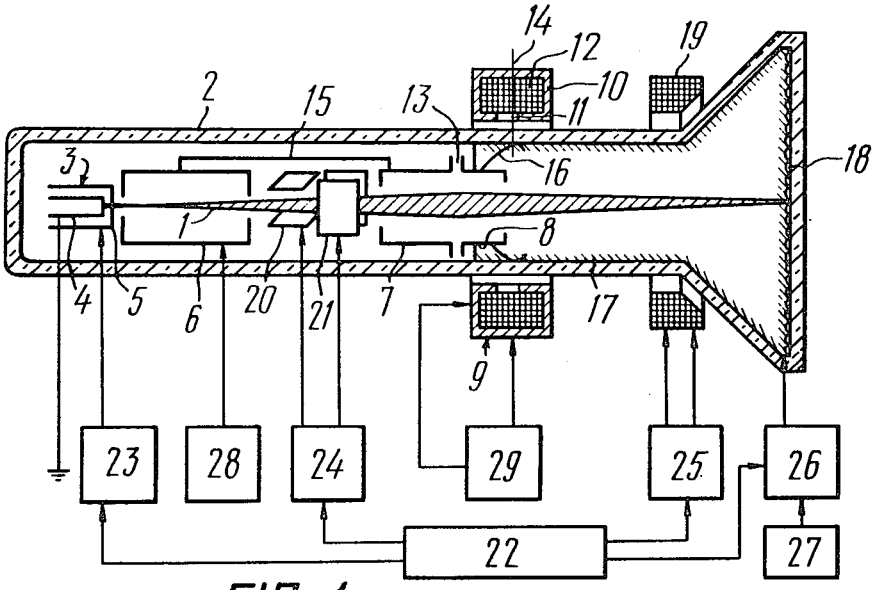
FIG. 1 is a longitudinal section view of a first embodiment of the proposed cathode-ray tube with variable energy of electrons in its beam, taken in conjunction with the block diagram of its control circuit.

Referring now to the drawings, the cathode-ray tube with variable energy of electrons in its beam comprises an axisymmetric system for shaping an electron beam 1 (FIG. 1), including, enclosed in a glass bulb 2, an electron source 3 in rear portion, made up of a cathode heater 4 and a modulator 5. The electron beam shaping system also includes an electron accelerating means arranged downstream of the modulator 5, that is toward a front portion of the bulb, along the beam axis, and made up of an accelerating electrode 6 in the form of a cylinder with holes being made in the sealed ends thereof for electrons to pass therethrough.

The electron beam shaping system furthermore includes an electron focusing means, incorporating an electrostatic bipotential lens made up of a first electrode 7 and a second electrode 8, both being arranged downstream of the accelerating electrode 6, along the beam axis, so as to form a gap therebetween, and shaped as cylinders. The electron focusing means also includes a magnetic lens built around a conventional electromagnetic coil 9 arranged externally of the bulb 2, with its magnetic core 10 having air gap 11 and accommodating a winding 12.

The electrostatic lens (7, 8) is so arranged with respect to the magnetic lens (9–12) as to ensure compensation for defocusing of the electron beam by the magnetic lens, due to variations in the energy of the beam electrons. In the present embodiment of the proposed cathode-ray tube, the electrostatic lens (7, 8) has a median plane 13 passing through the middle of the gap between the first and second electrodes 7 and 8, facing each other with their ends, and arranged intermediate of a median plane 14 of the magnetic lens (9–12), passing through the middle of the air gap 11, and the accelerating electrode 6.

The accelerating electrode 6 is electrically connected with the first electrode 7 of the electrostatic lens through a jumper 15. The second electrode 8 of the electrostatic lens is connected, through metal springs 16, with a conductive graphite coating 17 known as aquadag applied to the inner walls of the bulb 2 and passing into an aluminium coating applied to a screen 18 accommodated in the flaring front portion of the bulb 2. The screen 18 is a single-layer structure incorporating particles of a luminescent material $Y_2O_2S$:Eu which exhibit red luminescence as the electron beam 1 impinges upon the screen 18, the voltage across the screen 18 being equal to about 6 kV. The layer also incorporates particles of a luminescent material (ZnCd)SiCu, each particle being enveloped by a barrier layer and exhibiting green luminescence when the voltage across the screen 18 becomes equal to 12 kV.

Arranged externally of the bulb 2 downstream of the electromagnet coil 9, along the beam axis, is a primary means for deflecting the electron beam 1, in the front portion of the bulb 2, built around an electromagnetic coil 19 and enabling the screen 18 to be scanned by the electron beam 1.

Accommodated in the bulb 2, between the accelerating electrode 6 and the first electrode 7 of the electrostatic lens is an additional means for deflecting the electron beam 1, made up of two pairs of electrostatic deflection plates: vertical deflection plates 20 and horizontal deflection plates 21. This additional means is intended to make the electron beam 1 scan a restricted area of the screen 18, the position whereof is determined by the deflecting coil 19 and whose size corresponds to that of the character displayed on the screen 18 of the cathode-ray tube.

The operation of the proposed cathode-ray tube is controlled from a source 22 of control signals which is coupled, via a beam current control unit 23, to the modulator 5 and, via a character generator 24, to the electrostatic deflection plates 20 and 21. The source 22 is also connected, through an orthogonal deflection unit 25, to the deflecting coil 19 and, through a high-voltage switch 26, to the screen 13. The high-voltage switch 26, in turn, has a high-voltage power supply 27 connected thereto.

Independent power supplies 28 and 29 are respectively connected to the accelerating electrode 6 and to the electromagnetic coil 9 forming the magnetic lens. The cathode heater 4 of the proposed cathode-ray tube is grounded (this detail being omitted from the smaller-scale FIGS. 2 and 3).

The character generator 24 uses a conventional circuit (cf. "Display System Technique", Mir Publishers, Moscow, 1970, pp. 326–337 /in Russia/); the high-voltage switch 26 also uses a conventional circuit (cf. "Electron Industr.," France, 1968, No. 112, pp. 293–325).

Figure 2:
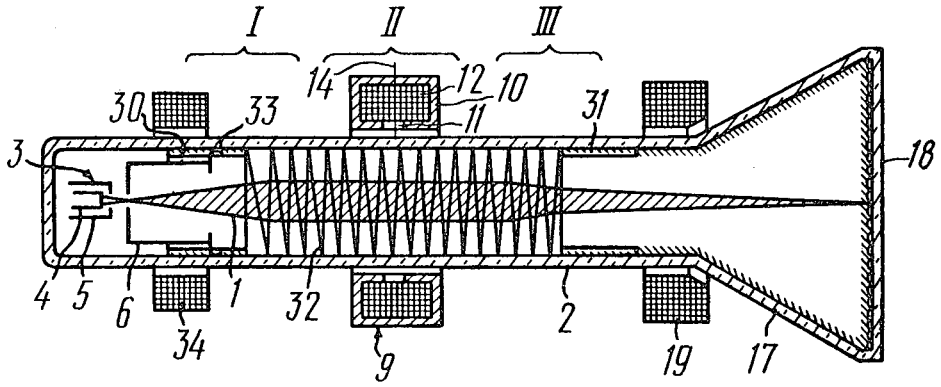
FIG. 2 is a longitudinal section view of a second embodiment of the proposed cathode-ray tube.
Figure 3:
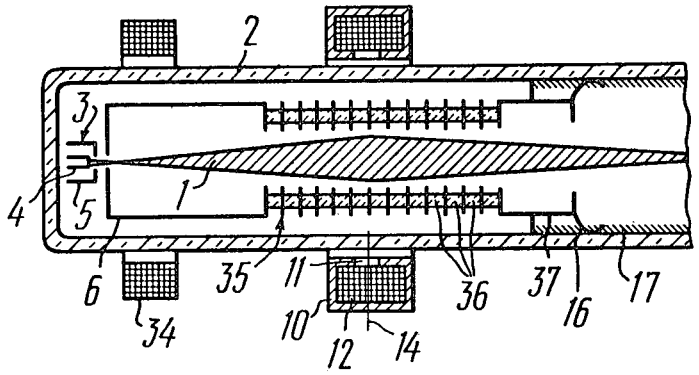
FIG. 3 is a longitudinal section view of a third embodiment of the proposed cathode-ray tube.

Another embodiment of the proposed cathode-ray tube with variable energy of electrons of its beam is possible and this is shown in FIG. 2. The set-up is basically similar to the one described above with the difference that the bipotential electrostatic lens (in FIG. 1, parts 7, 8) has electrodes 30 and 31 made preferably in the form of a conductive coating applied to the inner wall portions of the bulb 2 and, in the present embodiment, spaced apart by a distance which exceeds the internal diameter of the coated portion of the bulb 2. In addition, the ends of the electrodes 30 and 31, facing each other, are arranged on either side of the median plane 14 of the magnetic lens and electrically connected with each other through a means for setting up a distributed electric field, inserted between these electrodes, e.g. a helically bent strip 32, as shown.

In this embodiment of the cathode-ray tube, the electrode 30 is again electrically connected with the accelerating electrode 6, but through spring members 33, while the electrode 31 is an extension of the conductive coating 17, and the additional electron beam deflecting means is in the form of an electromagnetic coil 34 fitted onto the bulb 2.

The proposed cathode-ray tube with variable energy of electrons of its beam may have a third embodiment basically similar to the second one, the difference being that, number of diaphragms 35 (FIG. 3) are used as the means for setting up a distributed electric field, electrically interconnected through spacers 36 made from a resistive material. In addition, the first electrode (35, 36) of the electrostatic lens is made integral with the accelerating electrode 6, while a second electrode 37 is shaped as a cylinder with holes made in the sealed ends thereof, for the electron beam 1 to pass therethrough and, be electrically connected with the conductive coating 17 on the inner walls of the bulb 2, through the springs 16.

The proposed cathode-ray tube according to the first embodiment (FIG. 1) operates as follows.

As a signal is applied from the electron beam current control unit 23 (FIG. 1) to the modulator 5 of the electron source 3 and an accelerating voltage is fed from the power supply 28 to the accelerating electrode 6, an intensity-modulated divergent electron beam 1 is formed between the electron source 3 and the accelerating electrode 6. This beam 1 passes between two pairs of deflection plates 20 and 21 of the additional electron beam deflecting means, whereby it is deflected through an angle proportional to the signal applied to the plates 20 and 21 from the character generator 24. Then, the deflected but not yet focused divergent electron beam 1 passes through the electrostatic lens made up of the electrodes 7 and 8.

Assume now that the screen 18, hence the electrode 8, receives the lower of the two rated voltages, the one equal to 6 kV, the ratio between the voltages across the electrodes 7 and 8 making up the electrostatic lens and the intensity of the magnetic field inside the electromagnetic coil 9 making up the magnetic lens in such a way that each of the two lenses when taken separately, is too weak to independently provide for a sharp image of the beam cross-over to appear on the screen 18. A sharp image of the cross-over in the form of a spot of minimal size can only be obtained on the screen 18 when the electron beam is focused by both the electrostatic and the magnetic lenses.

As is well known, the magnification ratio of a combination of two lenses is equal to the product of their individual magnification ratios. Once the voltage across the screen 18, hence across the electrode 8 of the electrostatic lens, starts to be increased, with a given constant distribution of the magnetic-field intensity along the axis of the cathode-ray tube, attained by means of the power supply 29, the spot is defocused, in which case the focal power of the bipotential electrostatic lens increases due to a higher ratio between the voltages across the electrodes 7 and 8, while the focal power of the magnetic lens diminishes due to a higher rate of electrons of the beam 1 through this lens. The voltage across the electrode 8 reaching a certain level, the cross-over reappears on the screen 18. Thus, a spot of minimal size can be obtained on the screen at two preset voltages.

Since the required voltages across the screen 18, hence across the electrode 8, are usually determined by the luminescent material used, the focal power of the combination of lenses is selected accordingly by varying the distance between the median planes 13 and 14 of the electrostatic and magnetic lenses, respectively. The voltage across the electrode 7, as well as the intensity of the magnetic field inside the electromagnetic coil 9, make up the magnetic lens.

By varying the above parameters within a small interval, it is possible to regulate the two fixed voltages across the second electrode 8, hence across the screen 18, wherewith the electron beam can be automatically focused on the screen 18 within a wide range depending on the luminescent materials used in the screen.

As the linear magnification ratio of a combination of electrostatic and magnetic lenses practically remains invariable in the case of transition from one fixed voltage across the second electrode 8 to the other, this combination of lenses will realign the electron beam 1, deflected by the additional deflecting means e.g. 20, 21 or 34, with the axis of the cathode-ray tube with different voltages across the second electrode 8, i.e. when the electron beam 1 is refocused on the screen 18. The additional deflecting means deflects the electron beam 1 at a constant rate of electrons, with any one of the two fixed voltages across the screen 18 owing to this additional deflecting means being arranged upstream of the electrode 7, the voltage across which is maintained constant in the course of operation of the cathode-ray tube.

Thus, owing to the use of a combination of appropriately and mutually arranged bipotential electrostatic and magnetic lenses, not only stable focusing of the electron beam 1 on the screen 18 is attained, unaffected by variations in the energy of its electrons between two fixed limits (i.e. by varying accelerating voltage), but there is attained also a practically invariable sensitivity to deflection of the electron beam 1 by the additional deflecting means, which enables characters equal in size to be obtained on the screen 18 regardless of the extent to which the voltage across the screen 18 varies.

The cathode-ray tube in accordance with the second embodiment (FIG. 2) operates in a similar manner.

The only difference is due to the use of a "geometrically weak" extended bipotential electrostatic lens, instead of a "gemometrically strong" bipotential electrostatic lens as well as to a different mutual arrangement of the electrostatic and magnetic lenses. In the first embodiment of the proposed cathode-ray tube, the operation of the electrostatic and magnetic lenses is spatially separated, while in the second embodiment it is spatially brought closer together.

When one of the rated voltages ($U_1$), the one higher than that across the accelerating electrode 6 and the electrode 30 electrically connected therewith, is applied to the screen 18, hence to the electrode 31, the electrostatic lens 30 becomes an accelerating one.

For the sake of simplicity, in the following description of the operation of the second embodiment of the proposed cathode-ray tube, the left, central and right portions of the electrostatic lens, along the beam axis, are designated in the drawing as I, II and III, respectively.

Since the area corresponding to the portion I of the accelerating electrostatic lens is collecting, the electrons of the divergent beam 1 are acted upon by a radial force directed towards the tube axis. From the area corresponding to the portion I, the beam enters that area corresponding to the portion II in which a practically uniform electric field is set up. Along this portion II, too, the beam 1 is acted upon by a radial force determined by the action of the magnetic field of the electromagnetic coil 9, making up the magnetic lens, and directed towards the tube axis. The area corresponding to the portion III is scattering.

As a constant voltage $U_2$ which is lower than the voltage $U_1$ applied to the screen 18, hence to the electrode 31, is fed to the electrodes 6 and 30, the focal power of the magnetic lens is selected such as to enable the beam 1 to be focused on the screen 18 by the combined action of the electrostatic and the magnetic lenses.

An increase in the voltage $U_1$ is followed by that in the total focal power of the collecting and scattering portions I and III of the bipotential lens. If the focal power of the magnetic lens were constant, the beam 1 would be focused at a point upstream of the screen 18. However, the focal power of this lens decreases as the voltage $U_1$ increases since the rate of the electrons passing through the lens varies in proportion to the voltage $U_1$.

The focal power of the electrostatic lens does not increase proportionally with $k/U_1$ ($k$ is a constant determined by the geometry of the electrodes of this lens), but is a more complex function since the rate of electrons of the beam 1 steadily increases as the beam 1 passes through this electrostatic lens.

The combined action of the electrostatic lens which gradually becomes stronger and the magnetic lens which gradually becomes weaker as the voltage $U_1$ increases, permits practically stable focusing of the spot to be obtained on the screen 18 at any value of $U_1$ provided it is within a preset range determined by the luminescent material used in the screen 18. This rules out the necessity of employing additional units for dynamic focusing adjustment of the electron beam 1 as its energy varies, which units would otherwise complicate the control circuit of the cathode-ray tube.

The operation of the cathode-ray tube with variable beam electron energy according to the third embodiment (FIG. 3) is in perfect analogy with that of the just previously described one.

The proposed cathode-ray tube with variable energy of electrons of its beam permits the electron beam to be automatically focused on the screen at two fixed values of the beam electron energy or within a continuous broad range (6 to 20 kV and sometimes above) of electron energy variation.

In all of the above-described embodiments of the proposed cathode-ray tube, variations in the beam electron energy may occur both in the case of a constant voltage being maintained across the screen and in the case of varying the voltage across the cathode heater and accelerating electrode.

The use in the proposed cathode-ray tube of a magnetic and an electrostatic lenses makes it possible to obtain a higher resolution, the beam current intensity being equal to about 10μA. Experimentally, a resolution of 2,500 lines per screen has been obtained with the beam current intensity being 10μA.

Since in the proposed cathode-ray tube the intensity of the magnetic field of the magnetic lens is constant, the latter can be made up of any electromagnetic coil or permanent magnet. In the latter case, the power supply can be dispensed with. Another advantage offered by the use of a magnetic lens with a constant magnetic-field intensity resides in that it imposes no additional limitations on the quick response of the cathode-ray tube.

When the proposed cathode-ray tube is used in digital, alphabetic or symbolic (also called alphanumeric) information display units, the size of a character is maintained constant on the screen as the energy of the beam electrons varies.

What is claimed is:

1. A cathode-ray tube with variable energy of electrons of its beam, comprising: a glass bulb with a flaring portion; and electron source disposed in said bulb; electron accelerating means arranged in said bulb downstream of said electron source along the beam axis; electron focusing means arranged downstream of said electron accelerating means along the beam axis and cooperating with said electron accelerating means to form an electron beam; a magnetic lens with constant magnetic field intensity, forming part of said electron focusing means and having a median plane; an electrostatic lens defined in said electron focusing means, comprising two axisymmetric electrodes; said two electrodes having ends arranged on either side of said median plane of said magnetic lens, the distance therebetween exceeding the diameter of an end of a smaller one of said electrodes; said electrodes being electrically connected to each other by means for setting up a distributed electric field disposed between said electrodes; a first one of said electrodes being electrically connected with said electron accelerating means; screen means disposed in said flaring portion of said bulb and being coated with a luminophore, having luminescence which varies with a change of electron beam energy impinging upon said screen; a second one of said electrodes being electrically connected with said screen; electron beam deflecting means arranged downstream of said electron focusing means along the beam axis; a.d.c. voltage source connected with said accelerating means, adapted to create a potential on said first electrode; an a.c. voltage source connected to said screen for creating a potential on said second electrode, which latter potential is different from the potential of said first electrode, so that while altering the potential of said screen, and of said second electrode, a change of optical force formed by said electrodes being automatically made up for a reverse conjugated alteration of an optical force of said magnetic lens, and under different values of the potential of said screen, consecutively changed in time resulting in automatic invariable focusing of said beam on said screen; and other power sources electrically connected with said electron source, said deflecting means and said magnetic lens.

2. A cathode-ray tube as defined in claim 1, wherein said means for setting up a distributed electric field is made in the form of a strip of a resistive material, bent along a helical line.

* * * * *